United States Patent [19]

Winter, III

[11] 4,110,202

[45] Aug. 29, 1978

[54] HYDROGENATION PROCESS FOR PYROLYSIS LIQUIDS

[75] Inventor: George R. Winter, III, Mt. Prospect, Ill.

[73] Assignee: UOP Inc., Des Plaines, Ill.

[21] Appl. No.: 852,653

[22] Filed: Nov. 18, 1977

[51] Int. Cl.[2] ..... C10G 23/00

[52] U.S. Cl. ..... 208/144; 208/255

[58] Field of Search ..... 208/255, 97, 144, 142, 208/210

[56] References Cited

U.S. PATENT DOCUMENTS

| | | | |
|---|---|---|---|
| 2,878,179 | 3/1959 | Hennig | 208/144 |
| 3,133,013 | 5/1964 | Watkins | 208/210 |
| 3,161,586 | 12/1964 | Watkins | 208/255 |
| 3,492,220 | 1/1970 | Lempert et al. | 208/144 |

FOREIGN PATENT DOCUMENTS

| | | | |
|---|---|---|---|
| 923,062 | 3/1973 | Canada | 208/255 |

*Primary Examiner*—George Crasanakis

*Attorney, Agent, or Firm*—James R. Hoatson, Jr.; John F. Spears, Jr.; William H. Page, II

[57] ABSTRACT

A hydrocarbon conversion process for the hydrogenation of olefinic hydrocarbons wherein the feed is fractionated into a $C_4$–$C_5$ light fraction and a $C_6$–$C_8$ heavy fraction, the heavy feed fraction is mixed with the makeup hydrogen stream and passed upward through a first catalyst bed, the effluent of the first reaction zone is admixed with the recycle hydrogen stream and a first portion of the light feed fraction and passed upward through a second catalyst bed. At least a portion of the liquid which has passed through the second catalyst bed is cooled and admixed with a second portion of the light feed fraction.

6 Claims, 1 Drawing Figure

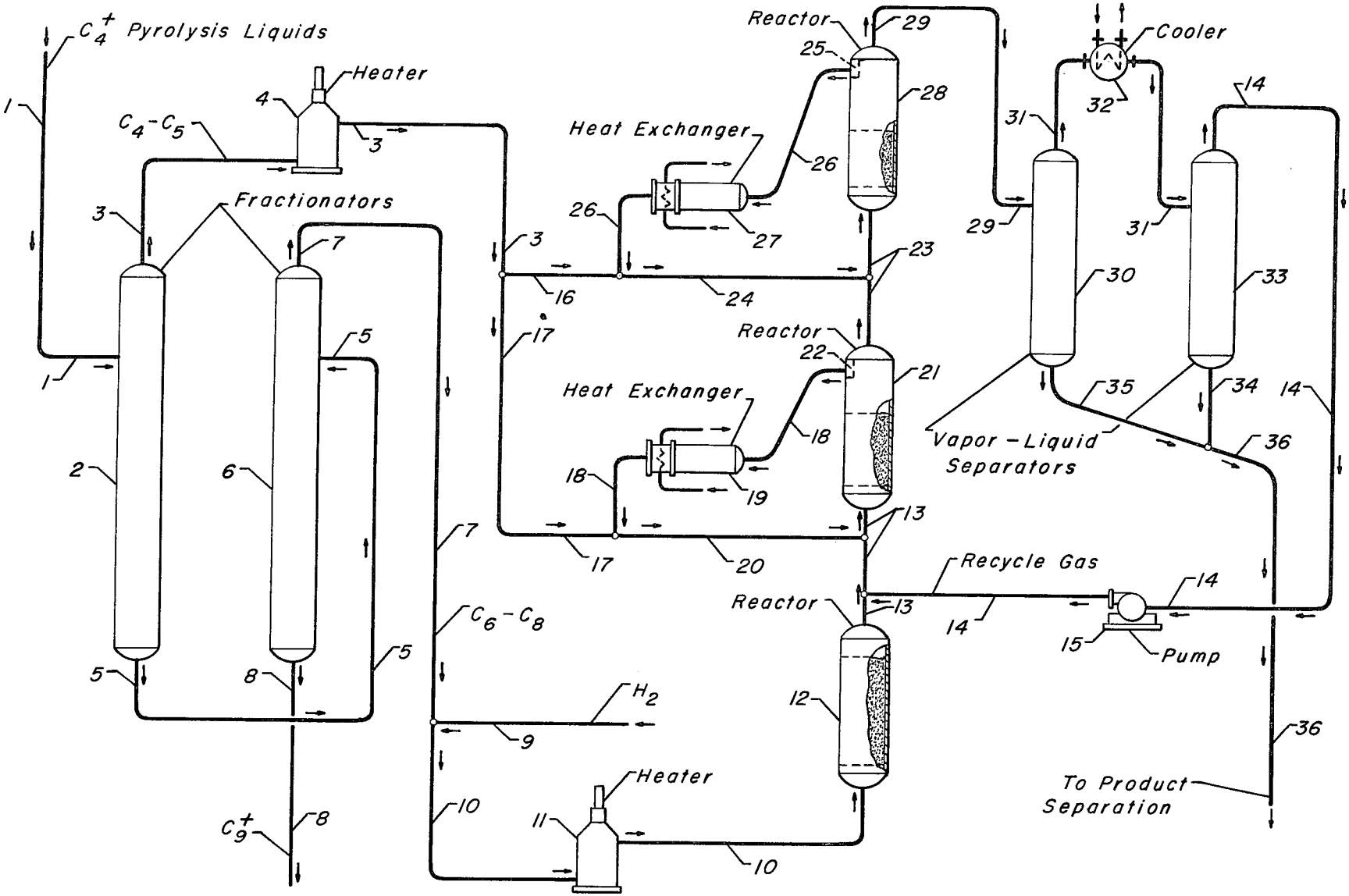
Cooler
Vapor - Liquid Separators
Recycle Gas
Pump
To Product Separation
Reactor
Heat Exchanger
Heater
Fractionators
$C_4^+$ Pyrolysis Liquids
$C_4 - C_5$
$C_6 - C_8$
$H_2$
$C_9^+$

HYDROGENATION PROCESS FOR PYROLYSIS LIQUIDS

FIELD OF THE INVENTION

The invention relates to a process for the conversion of mineral oils or hydrocarbons. More specifically, the invention relates to a process for the hydrogenation of various $C_4$–$C_8$ aromatic and acyclic olefinic hydrocarbons. References concerned with similar subject matter may be found, for instance, in Classes 208–143, 208–210, 208–243, 208–255 and 208–264.

PRIOR ART

The hydrogenation of olefinic hydrocarbons is a process which must often be performed in the refining of various petroleum-derived fractions. It has therefore received due attention and has become highly developed. Examples of the prior art are contained in U.S. Pat. Nos. 3,133,013 (Cl. 208–210); 3,161,586 (Cl. 208–264); 3,215,618 (Cl. 208–243); 3,537,918 (208–143) and 3,537,982 (Cl. 208–255).

In the process described in U.S. Pat. No. 3,133,013 the coke-forming distillate is fractionated into a light fraction and a heavy fraction, with the cut point being at a boiling point of about 250° F. to 280° F. The light fraction and the heavy fraction are separately reacted with hydrogen at a temperature of from about 300° F. to 500° F. At least a portion of each resultant reaction zone effluent is combined and then reacted with additional hydrogen in a third reaction zone at a temperature above about 500° F. A portion of the liquid separated from the effluent of the third reaction zone is recycled by admixture into the light and heavy fractions of the feed stream.

U.S. Pat. No. 3,161,586 presents a process wherein the feed is also fractionated into light and heavy fractions with the cut point being at a boiling point of about 250° F. to 280° F. One of these fractions is combined with the recycle hydrogen stream and passed through a first reaction zone. The effluent of this first reaction zone is combined with at least a portion of the first fraction and fed into a second reaction zone. The effluent of the second reaction zone is combined with additional hydrogen and passed into the third reaction zone. A portion of this third reaction zone's effluent is recycled by admixture into one of the fractions of the feed stream.

In the process presented by U.S. Pat. No. 3,215,618 the total coke-forming feed stream is admixed with a recycle stream and passed into a first reaction zone. The effluent of this zone is heated above 500° F., combined with additional hydrogen and then passed into a second reaction zone to complete the saturation of the hydrocarbons. The effluent of the second reaction zone is cooled and separated to yield a recycle gas stream. A portion of liquid-phase material derived from the effluent is preferably combined with the recycle gas stream to form the recycle stream admixed with the feed stream.

BRIEF SUMMARY OF THE INVENTION

The invention may be broadly characterized as a hydrocarbon conversion process which comprises the steps of fractionating a feed stream comprising $C_5$ diolefins and other olefinic hydrocarbons having between 4 and 8 carbon atoms per molecule to form a light fraction comprising $C_5$ hydrocarbons and a heavy fraction comprising $C_8$ hydrocarbons; admixing a makeup hydrogen stream with the heavy fraction and passing the heavy fraction upward through a first reaction zone; mixing the effluent of the first reaction zone with a first recycle liquid stream, a portion of the light fraction of the feed stream and the hydrogen-containing recycle gas stream and passing the resultant mixed-phase first reactant stream upward through a second reaction zone containing a second catalyst bed.

This process also comprises the subsequent steps of dividing the effluent stream leaving the second catalyst bed into a liquid-phase portion which is used as the first liquid recycle stream, and a mixed-phase second portion; admixing this mixed-phase portion of the effluent of the second catalyst bed with a second portion of the light fraction of the feed stream and a second liquid recycle stream, and passing the resultant mixed-phase second reactant stream upward through a third catalyst bed; dividing the effluent stream leaving the third catalyst bed into a liquid-phase portion, which is used as the second liquid recycle stream, and a mixed-phase second portion; and separating the second portion of the effluent of the third catalyst bed in a vapor-liquid separation zone to provide a liquid product stream and the recycle gas stream.

DESCRIPTION OF THE DRAWING

The drawing illustrates the preferred embodiment of the invention. For clarity and simplicity various subsystems and apparatus associated with the operation of the process have not been shown. These items include flow and pressure control valves, pumps, temperature and pressure monitoring systems, reactor and fractionator internals, etc., which may be of customary design. This representation of the preferred embodiment is not intended to preclude from the scope of the invention those other embodiments set out herein or which are the result of reasonable and normal modification of these embodiments.

Referring now to the drawing, a feed stream comprising $C_4$-plus pyrolysis liquids enters the process through line 1. The feed stream is fed into a fractionation zone comprising two fractionation columns 2 and 6. Fractionation column 2 is operated at fractionation conditions which are effective to cause the separation of the feed stream into an overhead stream comprising $C_4$ and $C_5$ hydrocarbons and a $C_6$-plus bottoms stream. The overhead stream of fractionation column 2, referred to herein as the light fraction of the feed stream, is removed in line 3 and passed through a heater 4. The bottoms stream of the fractionation column 2 is removed in line 5 and passed into fractionation column 6, which is operated at fractionation conditions effective to separate the entering material into an overhead stream of $C_6$–$C_8$ hydrocarbons and a second bottoms stream comprising hydrocarbons having 9 or more carbon atoms per molecule. This second bottoms stream is removed from the process in line 8.

The overhead product of the second fractionation column is removed in line 7 and is referred to herein as the heavy fraction of the feed stream. It is admixed with a makeup hydrogen stream from line 9. The resultant mixed-phase admixture is passed through a heater 11 via line 10 and is then passed into the bottom of a first reaction vessel 12. The admixture is therein contacted with a bed of solid catalyst maintained at hydrogenation-promoting conditions, and at least partial hydrogenation of olefinic hydrocarbons in the admixture is effected. The effluent stream of the first catalyst bed is removed in line 13 and is admixed with a recycle gas stream comprising hydrogen from line 14 and with a liquid stream from line 20. The liquid stream in line 20 is formed by the admixture of a first portion of the light fraction of the feed stream carried by line 17 and by a first recycle liquid stream carried by line 18. The resultant first reactant stream is passed into the second reaction vessel 21 and is passed upward through a second bed of solid catalyst which is also maintained at hydrogenation-promoting conditions.

The effluent stream of the second catalyst bed is divided into two portions within the reaction vessel 21. A first liquid-phase portion is collected in a trap 22 and withdrawn in line 18 to be pressurized by a pump not shown. This first portion is utilized as the first liquid recycle stream and is cooled in heat-exchange means 19 prior to recirculation though the second catalyst bed. The remaining portion of the effluent of the second catalyst bed is preferably a mixed-phase stream and is withdrawn from the second reaction vessel through line 23.

The second or mixed-phase portion of the effluent of the second catalyst bed is admixed with a liquid stream from line 24 to form a second reactant stream which is passed upward into a third reaction vessel 28. The liquid in line 24 is formed by the admixture of a second portion of the light fraction of the feed stream carried by line 16 and by a second liquid recycle stream carried by line 26. The second reactant stream is passed upward through a third catalyst bed maintained at hydrogenation-promoting conditions. As in the second reaction vessel, the effluent of a third catalyst bed is separated into two portions. A first liquid-phase portion is collected on a trap 25 and is removed through line 26 to be pressurized by a pump not shown. It is then cooled in heat exchange means 27 and recirculated. The remaining second or mixed-phase portion of the effluent of a third catalyst bed is removed through line 29.

The material in line 29 is passed into a vapor-liquid separation zone, which preferably comprises a first hot separator 30 and a second cold separator 33. A vapor stream is removed from the top of the hot separator in line 31 and is passed through a cooler 32 which causes the condensation of some of the heavier hydrocarbons in this vapor stream. It is then passed into the cold separator. The vapor stream removed from the top of the cold separator is utilized as the recycle gas stream of the process. A portion of this gas stream may be vented from the process to prevent the accumulation of light hydrocarbons. A compressor 15 is utilized to recirculate the gas stream. A liquid stream is removed from the bottom of the hot separator in line 35 and from the bottom of the cold separator in line 34. These two liquid streams are commingled and removed from the process as a liquid product in line 36. This product stream may be transferred to a product separation zone or to further refining operations.

DETAILED DESCRIPTION

In the petroleum refining and petrochemical industries, it is often necessary to hydrogenate olefinic hydrocarbons. This may be necessary to meet product specifications, to prevent the disposition of undesired films and coatings on the surfaces of equipment which contacts the olefinic hydrocarbon containing liquid or to prepare the olefinic hydrocarbon containing liquid for further processing. This further processing may be, for example, aromatic hydrocarbon separation or desulfurization. Those skilled in the art of petroleum refining are therefore well aware of the utility of hydrogenation processes.

As used herein the term "olefinic hydrocarbon" is intended to refer to both mono-olefinic and diolefinic hydrocarbons, which may be either acyclic or aromatic in structure. Specific examples are butenes, butadienes, amylenes, styrene, indenes, isoprene and dicyclopentadiene. The subject invention is specifically concerned with olefinic hydrocarbons having from about four to eight carbon atoms per molecule. A major source of such olefinic hydrocarbons is often referred to as pyrolysis liquids. Olefinic hydrocarbons are often contained in the effluent of a hydrocarbon conversion process in which the feed hydrocarbons are cracked, thereby forming olefins and diolefins. The hydrocarbon conversion process may be thermal cracking, catalytic cracking or destructive distillation. A specific example is the bottoms liquid of the ethylene column of a process unit which produces ethylene by thermal cracking a naphtha. Other suitable feedstocks include coke oven light oils, distillates from fluid cokers and coal gasification side-product liquids. The subject process may be applied to any feed stream having the requisite composition and is not limited to practice on pyrolysis liquids.

The various components of the feed stream may vary considerably in the manner in which they are best hydrotreated. For example, a $C_6$–$C_8$ cut of an ethylene column bottoms stream will typically have a diene value of about 15–20 and consume about 200 standard cubic feet per barrel (SCFB) of hydrogen while being hydrogenated. This material can be processed without the use of any liquid recycle and at a total hydrogen flow of about 500 SCFB or more. In comparison, a $C_4$–$C_5$ cut taken from the same stream may have a diene value of from 150 to 250 and consume 1500 to 2500 SCFB of hydrogen during processing. It is a normal practice to admix a sizable amount of reaction zone effluent material to the fresh $C_4$–$C_5$ cut. This liquid recycling is performed to dilute the olefinic hydrocarbons in the fresh $C_4$–$C_5$ cut and thereby lower the diene value of the total feed stream. The total hydrogen flow, based on fresh feed, should be maintained above about 25,000 SCFB during the processing of the $C_4$–$C_5$ feed stream.

Furthermore, experience has shown that it is not practical to attempt the simultaneous hydrogenation of the $C_5$ and $C_8$ olefinic hydrocarbons derived from pyrolysis liquids. This is believed to result from the reaction of $C_5$ diolefins with styrene to produce high molecular weight hydrocarbons which settle on the catalyst. It is therefore customary to divide the $C_5$ and the $C_8$ olefinic hydrocarbons into two separate streams by fractionation and to then process these streams separately. This division of the total feed stream is preferred. As used herein the term "light fraction" will refer to the portion of the fractionated feed stream which contains the majority of the $C_5$ hydrocarbons contained in the feed stream. In a similar manner the term "heavy fraction" will refer to the portion of the fractionated feed stream which contains the majority of the $C_8$ hydrocarbons contained in the feed stream.

It is an objective of the invention to provide a process for the hydrogenation of olefinic hydrocarbons. More specifically, it is an objective of the invention to provide a process for the hydrogenation of a $C_4$–$C_8$ feed stream comprising $C_5$ diolefins and styrene. It is another objective of the invention to provide a hydrogenation process requiring a reduced amount of liquid and vapor recirculation.

In the subject invention a plurality of reaction zones are utilized. The terms "reaction zone" and "hydrogenation zone" are used interchangeably herein. Preferably, the heavy fraction is treated separately in one reaction zone, and the light fraction is treated in two or more reaction zones. The total number of hydrogenation or reaction zones may therefore exceed that shown in the drawing and may be four or five. Each reaction zone will contain one or more beds of catalyst. These catalyst beds are preferably cylindrical, and they may be either fixed or moving beds of catalyst. Preferably, the catalyst moves downward by gravity flow from each reaction zone to one immediately below and the reactants pass upward through the catalyst beds countercurrent to the catalyst flow.

Each reaction zone is maintained at hydrogenation-promoting conditions. These conditions include a temperature within the broad range of from 250° F. to 500° F. Preferably, the reaction zones are maintained at a temperature of from about 270° F. to 400° F. Hydrogenation-promoting conditions also include a pressure in the broad range of from about 100 psig. to about 1200 psig., with the preferred pressures being in the range of 500 to 800 psig. Liquid hourly space velocities of from about 1.0 to 8.0 may be used in the reaction zones. A suitable catalyst for use in the process consists of 1/16-inch alumina spheres containing about 0.4 wt. % palladium and about 0.5 wt.% lithium. This catalyst may be manufactured by impregnating alumina using a solution of dinitrodianisole palladium, calcining the spheres, incorporating lithium using lithium nitrate and again calcining the spheres. Other catalysts may also be used.

In the subject process the heavy fraction of the feed stream is admixed with the makeup hydrogen stream and passed into the first hydrogenation zone as a mixed-phase stream. This stream passes upward through a first bed of catalyst and at least some of the olefinic hydrocarbons in the heavy fraction are hydrogenated. No recycle gas or liquid need be passed into this first hydrogenation zone.

The light fraction of the feed stream is processed in a different manner. It is divided into two or more portions, with each portion being directed to a different hydrogenation zone. A first portion of the light fraction of the feed stream is passed into a second hydrogenation zone. Prior to entering the second hydrogenation zone it is admixed with three other streams, an operation which can of course be done in several different sequences. These three streams are: (1) a liquid recycle stream; (2) the effluent stream of the first hydrogenation zone; and (3) the hydrogen-containing recycle gas stream. The stream which results from admixing these four streams together is referred to herein as the first reactant stream. The mixed-phase first reactant stream is passed upward through the second catalyst bed contained in the second hydrogenation zone. The amount of the resultant hydrogenation should be at least sufficient to convert substantially all $C_5$ diolefins in the entering reactants to mono-olefins.

The effluent stream of the second catalyst bed is a mixed-phase stream. It is separated into a liquid-phase first portion and a mixed-phase second portion. As readily apparent to those skilled in the art, this separation can be performed in several ways. For instance, the catalyst bed effluent stream could be withdrawn from the vessel containing the second catalyst bed and passed into an external phase separation zone. Preferably, a portion of the liquid phase of the catalyst bed effluent stream is collected in an imperforate trap or trough as shown in the drawing. The suction line of a pump communicates with the trap to remove the recycle liquid. As there is more liquid in the catalyst bed effluent than is utilized as recycle liquid, the required separation may be easily performed with such a relatively simple device. The separated first portion of the catalyst bed effluent is the recycle liquid admixed into the first portion of the light fraction of the feed stream. The recycle liquid stream may be cooled to remove heat generated by the hydrogenation reaction. Its rate of flow will be set by the desired operating conditions, etc.

The second portion of the light fraction of the feed stream is admixed with a second recycle liquid formed in a manner similar to that just described. It is also admixed with the mixed-phase second portion of the effluent stream of the second catalyst bed. The resultant admixture is referred to herein as the second reactant stream and is contacted with a third bed of catalyst. The effluent stream of the third catalyst bed is also separated into a liquid-phase first portion and a mixed-phase second portion. The first portion is cooled if necessary and then used as the second recycle stream. The remaining second portion is preferably passed into a phase separation zone wherein substantially all of the hydrogen in it is recovered to form the recycle gas stream. The second portion of the effluent stream may alternatively be admixed with a third liquid recycle stream and a third portion of the light fraction of the feed stream and then passed into yet another hydrogenation zone.

The phase separation zone may be constructed and operated according to guidelines well known in the art. One suitable configuration is shown in the drawing. As an alternative, the upper portion of the reaction vessel may be used as the hot separator. This is an advantage of using upward liquid flow. The phase separation zone should recover substantially all of the remaining hydrogen for reuse. This zone should also concentrate the great majority of all hydrocarbons having more than 2 carbon atoms per molecule present in the second portion of the effluent stream of the last catalyst bed into a net product or effluent stream which is removed from the process.

In accordance with this description one embodiment of the invention may be characterized as a hydroconversion process which comprises the steps of fractionating a feed stream which comprises $C_5$ diolefins and other olefinic hydrocarbons having between 4 and 8 carbon atoms per molecule to form a light fraction comprising hydrocarbons having 5 carbon atoms per molecule and a heavy fraction comprising hydrocarbons having 8 carbon atoms per molecule; admixing said heavy fraction with a first vapor stream comprising hydrogen at the rate of from 500 to 5000 SCFB and contacting a resultant mixed-phase admixture with a first bed of catalyst by passage through a first reaction zone maintained at hydrogenation-promoting conditions and forming a first catalyst bed effluent stream; dividing the light fraction of the feed stream into a first and a second aliquot portion; admixing the first portion of the light fraction with a first recycle liquid stream, the first catalyst bed effluent stream and a recycle gas stream comprising hydrogen and thereby forming a mixed-phase first reactant stream; contacting the first reactant stream with a second bed of catalyst by upward passage through a second reaction zone maintained at hydrogenation-promoting conditions and forming a second catalyst bed effluent stream; admixing a liquid-phase first portion of the second catalyst bed effluent stream with the first portion of the light fraction as the previously specified first recycle liquid stream; admixing a mixed-phase second portion of the second catalyst bed effluent stream, which comprises vapor-phase hydrogen, with the second portion of said light fraction and a second recycle liquid stream and thereby forming a mixed-phase second reactant stream; contacting the second reactant stream with a third bed of catalyst by upward passage through a third reaction zone maintained at hydrogenation-promoting conditions and forming a third catalyst bed effluent stream; admixing a liquid-phase first portion of the third catalyst bed effluent stream with the second portion of said light fraction as the previously specified second recycle liquid stream; and, separating a mixed-phase second portion of the third catalyst bed effluent stream into a liquid-phase product stream and a second vapor stream, and recycling at least a portion of the second vapor stream as the recycle gas stream which is admixed with the first portion of the light fraction of the feed stream.

The subject process has several unique characteristics. For instance, all of the liquid and the unreacted hydrogen which emerges in the effluent of the first catalyst bed is fed into the subsequent catalyst beds. Another characteristic of the process is that no recycle gas or liquid is passed into the first catalyst bed and reaction zone, but all of the recycle gas is passed into the second reaction zone and catalyst bed. Also, the process does not utilize a recycle liquid removed from the vapor-liquid separation zone in which the product stream is produced. The process does, however, provide at least two internal recycle streams. Each of these internal recycle streams has a different composition than the other internal recycle streams or the product streams.

The process has several advantages. They include the fact that no recycle gas compressor is needed for the first reaction zone since only the makeup gas stream is fed into this zone. Another advantage is provided by staging the light fraction of the feed stream into multiple reaction zones. The hydrogen and liquids in the effluents of the upstream reaction zone serve as recycle hydrogen and recycle liquid in the downstream reactor. This reduces the pounds per hour of recycle gas and recycle liquid compared to the use of a single reaction zone. Compared to a prior art flow scheme, the subject process would reduce the total recycle gas flow by 225 million standard cubic feet per day and the recycle liquid flow by about 15,000 BPD (barrels per day). This is based on a feed stream flow rate of 4500 BPD. This reduction in recycled fluids results in a corresponding reduction in the utilities cost of operating the process.

I claim as my invention:

1. A hydroconversion process which comprises the steps of:

(a) fractionating a feed stream which comprises $C_5$ diolefins and other olefinic hydrocarbons having between 4 and 8 carbon atoms per molecule to form a light fraction comprising hydrocarbons having 4 and 5 carbon atoms per molecule and a heavy fraction comprising hydrocarbons having 6 to 8 carbon atoms per molecule;

(b) admixing said heavy fraction with a stream comprising hydrogen at the rate of from 500 to 5000 SCFB and contacting the mixed-phase admixture with a first bed of catalyst by passage through a first reaction zone maintained at hydrogenation-promoting conditions and forming a first catalyst bed effluent stream;

(c) admixing a first portion of said light fraction with: (1) a hereinafter described first recycle liquid stream; (2) said first catalyst bed effluent stream and (3) a recycle gas stream comprising hydrogen and thereby forming a mixed-phase first reactant stream;

(d) contacting said first reactant stream from step (c) with a second bed of catalyst by passage through a second reaction zone maintained at hydrogenation-promoting conditions and forming a second catalyst bed effluent stream;

(e) admixing a liquid-phase first portion of said second catalyst bed effluent stream from step (d) with said first portion of said light fraction of step (c) as the previously specified first recycle liquid stream of step (c);

(f) admixing a mixed-phase second portion of said second catalyst bed effluent stream, which includes hydrogen, from step (d) with: (1) a second portion of said light fraction; and (2) a hereinafter described second recycle liquid stream and thereby forming a mixed-phase second reactant stream;

(g) contacting said second reactant stream from step (f) with a third bed of catalyst by passage through a third reaction zone maintained at hydrogenation-promoting conditions and forming a third catalyst bed effluent stream;

(h) admixing a liquid-phase first portion of said third catalyst bed effluent stream from step (g) with said second portion of said light fraction of step (f) as the previously specified second recycle liquid stream of step (f); and, (i) separating a mixed-phase second portion of said third catalyst bed effluent stream from step (g) into a liquid-phase product and a vapor stream, and recycling at least a portion of said vapor stream as said recycle gas stream in step (c).

2. The process of claim 1 wherein said feed stream comprises $C_4$–$C_8$ olefinic hydrocarbons formed in a pyrolytic hydrocarbon conversion process.

3. The process of claim 2 wherein said first recycle liquid stream of step (c) and said second recycle liquid stream of step (f) are (1) removed from a reaction vessel containing said second bed of catalyst and a reaction vessel containing said third bed of catalyst, respectively, as liquid streams ,20 and, (2) said liquid streams are cooled prior to admixture with said first and said second portion of said light fraction respectively.

4. The process of claim 2 wherein catalyst is moved by gravity-flow downward through said third, second and first reaction zones countercurrent to upward flowing liquid phase reactants.

5. The process of claim 4 wherein said third reaction zone is located above said second reaction zone, said second reaction zone is located above said first reaction zone, and catalyst flows from said second reaction zone into said first reaction zone.

6. The process of claim 3 wherein the stream comprising hydrogen in step (b) is a makeup hydrogen stream which is not derived from said third catalyst bed effluent stream.

* * * * *